US005154602A

United States Patent [19]

Harrison

[11] Patent Number: 5,154,602

[45] Date of Patent: Oct. 13, 1992

[54] MULTIPLE INK ROLL SYSTEM FOR FLEXOGRAPHIC PRINTING STATIONS

[75] Inventor: John R. Harrison, Baltimore, Md.

[73] Assignee: Ward Holding Company, Inc., Wilmington, Del.

[21] Appl. No.: 703,296

[22] Filed: May 20, 1991

Related U.S. Application Data

[63] Continuation-in-part of Ser. No. 556,887, Jul. 23, 1990, Pat. No. 5,081,928.

[51] Int. Cl.[5] ..... B41F 31/04; B41F 31/08

[52] U.S. Cl. ..... 101/351; 101/366

[58] Field of Search ..... 101/350, 363, 351, 352, 101/364, 207-210, 148, 366, 157, 169; 118/261, 259, 263

[56] References Cited

U.S. PATENT DOCUMENTS

| | | | |
|---|---|---|---|
| 1,024,473 | 4/1912 | Firm . | |
| 1,911,048 | 5/1933 | Adgit et al. . | |
| 1,980,639 | 11/1934 | Schlesinger . | |
| 2,026,480 | 12/1935 | Lougee | 101/349 |
| 3,306,197 | 2/1967 | Jensen et al. . | |
| 3,630,146 | 12/1971 | Shields | 101/351 |
| 3,734,014 | 5/1973 | Oda . | |
| 3,785,288 | 1/1974 | Hunter | 101/103 X |
| 3,793,952 | 2/1974 | Neumann et al. . | |
| 4,150,621 | 4/1979 | Raible . | |
| 4,370,926 | 2/1983 | Hattori . | |
| 4,397,237 | 8/1983 | Makosch . | |
| 4,528,907 | 7/1985 | Davison | 101/219 |
| 4,744,297 | 5/1988 | Sardella et al. . | |
| 5,003,876 | 4/1991 | Harrison et al. | 101/425 |

*Primary Examiner*—J. Reed Fisher

*Attorney, Agent, or Firm*—Boyce C. Dent; Edward D. C. Bartlett

[57] ABSTRACT

A printing apparatus has a plurality of ink rolls, particularly anilox rolls, for a single printing cylinder at any one of a number of similar and serially arranged printing stations, each station having one ink roll at a time being selected for use in cooperation with either a wipe roll assembly or a doctor blade assembly associated with each station. The various assemblies are surrounded by respective movable cover members which allow the assemblies to either print, or be washed or cleaned, at the same time that a similar printing or cleaning operation is taking place at an adjacent printing station. A movable subframe adjacent the main frame carries the ink rolls and their associated movable cover members as well as both the wipe roll assembly and the doctor blade assembly. Preferably, the subframe is translated with respect to the main frame to upper and lower positions to thereby effect either the printing or cleaning operations, and all the operative assemblies on the subframe may be disposed above the print cylinder carried by the main frame.

29 Claims, 5 Drawing Sheets

FLUID SUPPLY
FLUID SUPPLY

MULTIPLE INK ROLL SYSTEM FOR FLEXOGRAPHIC PRINTING STATIONS

CROSS REFERENCE TO RELATED APPLICATION

This is a continuation-in-part of copending U.S. patent application Ser. No. 556,887 filed 23 Jul., 1990 (now U.S. Pat. No. 5,081,928).

FIELD OF THE INVENTION

This invention relates to printing, particularly flexographic printing, and is concerned with providing a multiple ink roll system for the or each printing station in a printing apparatus.

The invention is also concerned with printing and washing operations at such printing station.

BACKGROUND OF THE INVENTION

A conventional flexographic printing station has a printing cylinder (also called a die cylinder) and an impression cylinder between which sheets, for example corrugated paper board blanks, are sequentially advanced for flexographic printing thereon. A printing die is mounted on the printing cylinder, for example by vacuum as disclosed in U.S. Pat. No. 4,744,297. Ink is applied to the printing die by an ink applicator roll (usually an anilox roll) which may have an engraved surface providing ink cells for holding ink to be transferred to the printing die. The ink may be squeegeed into the cells of the anilox roll by a rubber (or plastic) covered wipe roll rotating in tangential contact with the anilox roll, or it may be applied by a doctor blade assembly. Anilox rolls with different surface screens are available, e.g. surfaces formed with small pyramids or quadrangles or hexagon shapes or having channels therein etc. These differently engraved anilox rolls can provide different printing qualities. When installing a new printing station, the anilox roll may be chosen which best suits the majority of the printing intended to be performed at that printing station. In this way, the choice of the particular anilox roll is often a compromise.

SUMMARY OF THE INVENTION

It is an object of the invention to provide an apparatus having a plurality of ink rolls, particularly anilox rolls, for a single printing cylinder at a printing station, or at any one of a number of similar and serially arranged printing stations, each station having one ink roll at a time being selectable for use in cooperation with the or any inking system associated with that station.

As disclosed in my aforementioned copending application Ser. No. 556,887, the complete disclosure of which is incorporated herein by reference, a subassembly may be provided containing the plurality of ink rolls. This ink roll subassembly is preferably mounted between rotatable gear casings containing gears for drivingly rotating at least the selected ink roll. Thus, a plurality of ink rolls, such as three, may be mounted for rotation on parallel spaced-apart axes in a subassembly itself rotatable with respect to a subframe mounted adjacent the printing cylinder.

As further disclosed in my aforementioned copending application Ser. No. 556,887, there are preferably provided at least two inking systems comprising a wipe roll on one side of the selected ink roll and a doctor blade assembly on the other side of the selected ink roll. Such wipe roll and doctor blade assemblies may be movable to totally inoperative positions to make room for rotational movement of the ink roll assembly when selecting another one of the ink rolls for use.

An object of a preferred embodiment of the invention is to provide for a wipe roll assembly and a doctor blade assembly to be surrounded by respective movable cover members which allow the assemblies to either print or be washed or cleaned at the same time as one or more operations are taking place at an adjacent station.

A feature of the present invention is to mount a movable subframe adjacent the main frame carrying the printing cylinder, preferably above the printing cylinder, the subframe carrying a plurality of ink rolls and their associated movable cover members as well as both the wipe roll assembly and the doctor blade assembly.

Another feature is the provision of a movable subframe (with respect to the mainframe) for supporting the ink roll assembly, the wipe roll assembly and the doctor blade assembly so that movement of the ink roll assembly into and out of engagement with the printing cylinder will not interfere with a similar movement or with a printing operation or with a cleaning or washing operation which is being simultaneously performed at an adjacent printing station. Preferably, the movement of the entire subframe carrying the aforementioned assemblies is translated vertically, whereby any lateral or horizontal movement of the subframe is eliminated, and interference with any of the structure in an adjacent printing station is thereby avoided.

Accordingly, therefore, there is provided by one aspect of the present invention an apparatus having a main frame, a printing cylinder rotatably supported by the main frame, a subframe supporting thereon an anilox or ink roll assembly and an ink or fluid supplying assembly for cooperating with the anilox roll assembly. The subframe is moved, preferably translated in a vertical direction, with respect to the main frame to thereby move the anilox roll assembly thereon into and out of engagement with the printing cylinder for effecting, respectively, a printing operation and a cleaning operation.

Preferably, movable cover members, which may be cylindrical and rotatable about a common axis, surround the anilox roll assembly and are movable into selected positions for allowing, on the one hand, the anilox roll assembly to cooperate with the printing cylinder during a printing operation to thereby keep paper dust from contaminating the inking system, and on the other hand, for allowing the covers themselves to cooperate with the fluid supplying assembly during either a printing operation or a cleaning operation and so keep the ink or cleaning fluid supplied (depending upon which type of operation is in progress) to the fluid supplying assembly and the anilox roll assembly, from leaking or spilling on to the printing cylinder.

An additional cover may partially surround the wipe roll, which cover may cooperate with movable covers surrounding the ink roll assembly both during the printing operation and during the cleaning operation of the ink roll assembly and the wipe roll assembly.

The cooperation between the movable cover members surrounding the ink roll assembly and part of the doctor blade assembly during a printing operation, may be arranged so that the anilox roll assembly during printing is kept free from paper dust that normally accumulates in the atmosphere during a printing operation (particularly when die-cutting, slotting and/or similar such operations are also being performed).

A fluid outlet may be provided and connected to the fixed cover member associated with the wipe roll assembly and also one of the movable cover members associated with the anilox roll assembly. The outlet associated with the fixed cover member serves to carry away excess ink, in the case of an ongoing printing operation, or in conjunction with the outlet associated with the movable cover, excess cleaning fluid, in the case of an ongoing cleaning operation for both the wipe roll assembly and the anilox roll assembly. Preferably, the fluid outlets are connected to flexible conduits or hoses at strategic locations in the cover members, wherein the fixed member includes, also, a drain-off channel for cooperating with the ends of the ink roll during a printing operation; the flexible hose associated with the outlet for the fixed cover member can be connected to the ink supply or the cleaning fluid supply, depending on which type of operation is to be performed. The flexible hose associated with the outlet for the movable cover member may only be used with the cleaning fluid supply.

A separate ink supply line or channel may be provided for the fixed cover member so that, once an anilox roll is selected for use with the printing cylinder, the ink supply line is then connected with an ink supply hose, preferably a flexible hose that connects to an ink supply in the case of a printing operation or to a cleaning fluid supply in the case of a cleaning operation.

The doctor blade assembly may be provided with a fluid supply line integral therewith as well as a fluid overflow release line, both lines preferably being connected to flexible conduits or hoses that lead to a fluid supply, which is ink in the case of a printing operation and a cleaning fluid in the case of a cleaning operation.

The selected operative positions of the wipe roll assembly and the doctor blade assembly are preferably at roughly the same location on the periphery of the selected ink roll of the ink roll assembly.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like reference characters in the same or different drawings indicate like parts:

FIG. 6 is a side elevation view partly in section taken generally in the plane of the line 6—6 of FIG. 5;

DETAILED DESCRIPTION OF THE PREFERRED EMBODIMENT

The preferred embodiment of a single printing station employing the present invention is shown in FIGS. 1–9. The preferred printing station may be a printing section in a flexographic printing machine. This may be the only printing station in the machine, or the machine may have a number of such stations sequentially arranged one after another, each incorporating the same general structure as an adjacent station. The printing station, or stations, may conveniently be incorporated in a sheet processing machine for performing additional operations such as, for example, slotting, creasing, die cutting, etc.

Figures 1, 1A, 2:
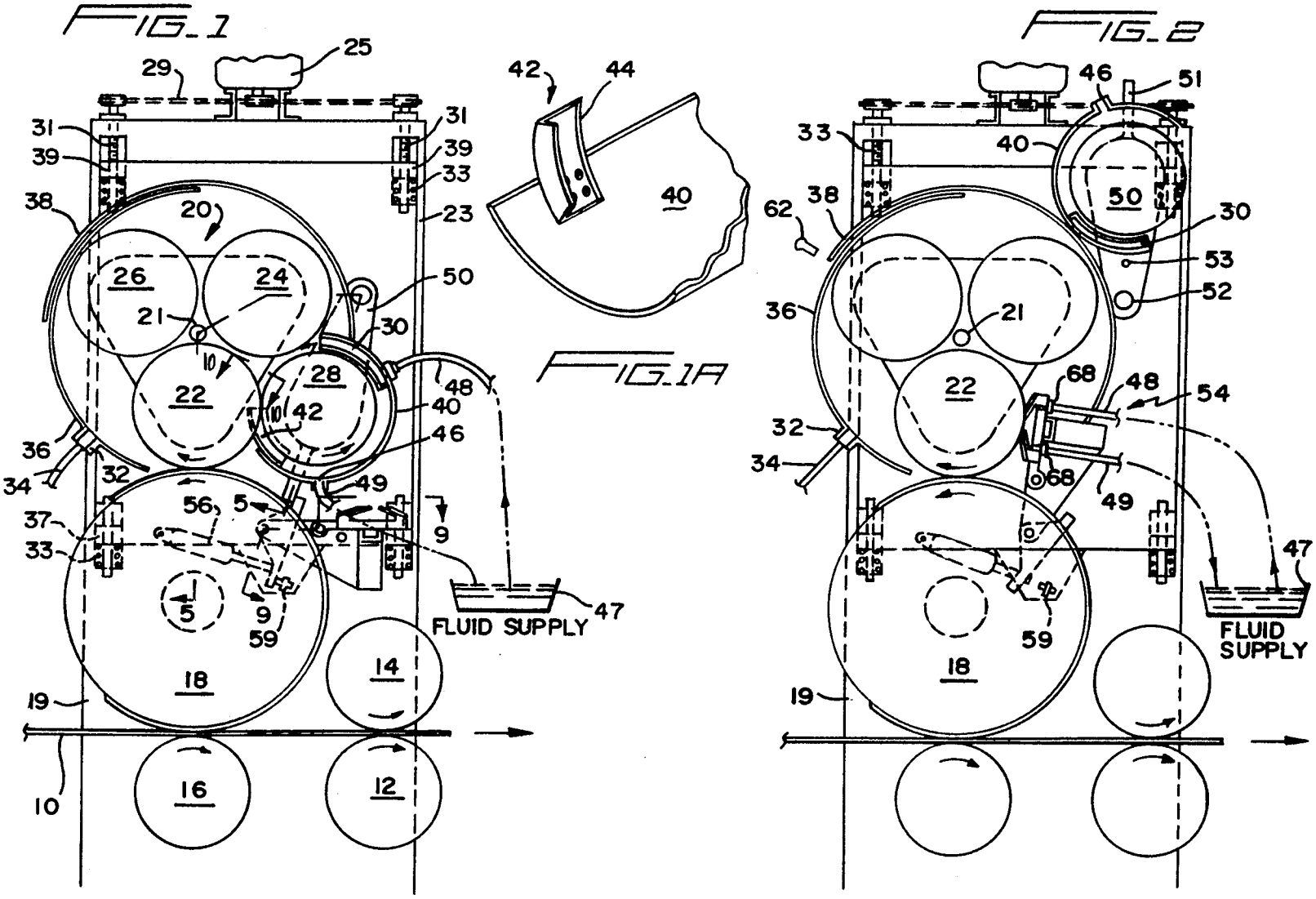
FIG. 1 is a partial schematic view in elevation in which a single printing station according to the invention is shown in the course of a printing operation using the wipe roll mode of operation.
FIG. 1A is a schematic perspective of part of the cover assembly for the wipe roll shown in FIG. 1.
FIG. 2 is a partial schematic view in elevation in which a single printing station according to the invention is shown in the course of a printing operation using the doctor blade mode of operation.

Referring now to FIG. 1, there is shown by way of example one of the aforementioned several printing stations. A sheet 10 is shown moving in the direction of the arrow between a pair of nip rollers 12, 14 that carry the sheets from the printing station as a printing operation is performed and completed. Prior to exiting the printing station, the sheet 10 is seen to extend between an impression roller 16 and a printing cylinder 18 so that the sheet 10 is printed on the topside thereof. Returning now to FIG. 1, it will be seen that the printing cylinder is supported on a main frame 19. An anilox roll assembly 20 is pivotally supported about an axis 21 on an inner or subframe 23; the anilox roll assembly consists, preferably, of three anilox rolls 22, 24, 26 with its lowermost roll 22 rotating clockwise in the opposite rotational direction to the printing cylinder 18 with which it is engaged. Except for the subframe structure and disposition of the anilox roll assembly, the doctor blade assembly and the wipe roll assembly with respect to the printing cylinder, the drive motors, gears, belts, clutches for these assemblies are the same as disclosed in my above copending patent application Ser. No. 556,887. The inner or subframe 23 is translated up and down in a vertical direction to thereby position the selected anilox roll in engagement or disengagement with the printing cylinder. For this purpose a servo motor 25 is located on a main frame 19 and, by means of a suitable belt or chain drive 29, turns a pair of screw members 31 that cause the inner frame to raise or lower depending upon which direction the screws members 31 are turned. The threaded shafts of the screw members 31 are seen to extend through threaded brackets 39 and are then journaled at the base of respective wells where they are surrounded by coil springs 33 (see also FIG. 5). The springs are normally biased against the brackets 39, and so serve to assist the motor when it is turning the screws in a direction to raise the subframe 23. As shown in FIG. 1, a pair of guide posts 37 are disposed in the lower section of the subframe to act as guides when this inner frame is being moved. Further springs 33 surround these posts and also act to bias the inner frame upwardly (see also FIG. 5). By virtue of the vertical translatory movement of the inner or subframe 23 with respect to the main frame 19, there is no need for horizontal or other movement of the inking members at a printing station such as to interfere with the parts or structure of an adjacent printing station. In this way, the inner frames of respective and adjacent printing stations can be moved up and down at will regardless of opposite and simultaneous movements taking place at adjacent stations. Particularly, there is no need to separate adjacent sections when moving the inner frame 23, and the units mounted therein, up and down. In other words, a printing operation can be performed at one station while a cleaning operation is prepared for and performed at an adjacent station, and vice versa.

Returning now to FIG. 1, ink is supplied to the surface of the selected anilox roll 22 by a wipe roll 28 in surface contact with the anilox roll 22, and also by means of the ink supply channel or conduit 30, to be more fully explained below.

Also shown in FIG. 1, and in accordance with the principles of the present invention, is the provision of a pair of concentrically mounted cylindrical covers 36, 38 which together partially surround the anilox roll assembly 20, to be more fully described with respect to FIG. 5 below. Additionally, there is provided a further fixed cover 40 partially surrounding the wipe roll 28, which is shown pivoted to its operative position, as described above. One end of the cover 40 is shown contacting the end of cover 38, while the other end of cover 40 is seen to stop short of the selected anilox roll 22 so as not to interfere with its operation. In order to perform a fluid or liquid-catching function (ink or cleaning fluid, for example) just below the nip between anilox roll 22 and wipe roll 28, the cover 40 has attached near its respective ends by suitable attaching means, such as rivets, screws or welding, right angled extension members 42, whose edges ride against the respective end faces of the anilox roll 22 by means of a suitable felt or other flexible seal member 44 attached thereto, and as best shown in FIG. 1A.

Still referring to FIG. 1, it will be seen that the fixed cover 40 has an outlet 46 disposed near the bottom thereof, which may be connected to a flexible conduit 49 that leads back to a fluid supply 47, either ink or cleaning fluid depending upon which operation, printing or cleaning, is in progress. Also leading from the fluid supply 47 is another flexible conduit 48 which has its terminal end adapted for connecting to the supply line channel 30 disposed on the inner periphery of the fixed cover 40, to be more fully explained below. A fluid outlet 32 in the movable cover 36 is drawn connected to flexible conduit 34, to be more fully explained below.

Referring now to FIG. 2, there is shown the printing station undergoing again a printing operation, but using in this case the alternative ink supplying system in the form of a doctor blade assembly as generally described in my aforementioned copending application Ser. No. 556,887. In this arrangement the wipe roll 28, with its attendant fixed cover 40, is swung or pivoted into an inoperative position by means of its support arm 50 about the pivot 52, as shown. A bi-directional gear motor, to be more fully explained below, is used for rotating the support arm 50 and for moving the wipe roll assembly. A locking pin 53 can be used to fix the wipe roll assembly in its inoperative position. A doctor blade assembly 54 is swung into an operative position with respect to the selected anilox roll 22, as shown. The doctor blade assembly 54 is swung about pivot 58 for operative engagement with the selected anilox roll 22. The concentric movable covers 36, 38 are moved or revolved about the anilox roll assembly pivotal axis 21, so that one end of the cover 38 abuts against the doctor blade assembly, as shown, and the other end of the cover 36 is positioned just outside the nip between the selected anilox roll 22 and the printing cylinder. A suitable key member 62, or some such other mechanical means, can be provided to fix the movable cover 36 with respect to the other movable cover 38. A fluid supply line 48 feeds into the top of the doctor blade housing, as shown, and a suitable opening in the cover 38 is provided to allow passage of the supply line 48 therethrough. A fluid return line 49 runs out from the bottom of the doctor blade housing. Both these lines are connected by suitable releasable connectors 68 to the flexible hoses or conduits 48, 49, respectively, which lead to the fluid supply 47 of ink or cleaning, depending on the type of operation to be performed at the printing station.

Figure 4:
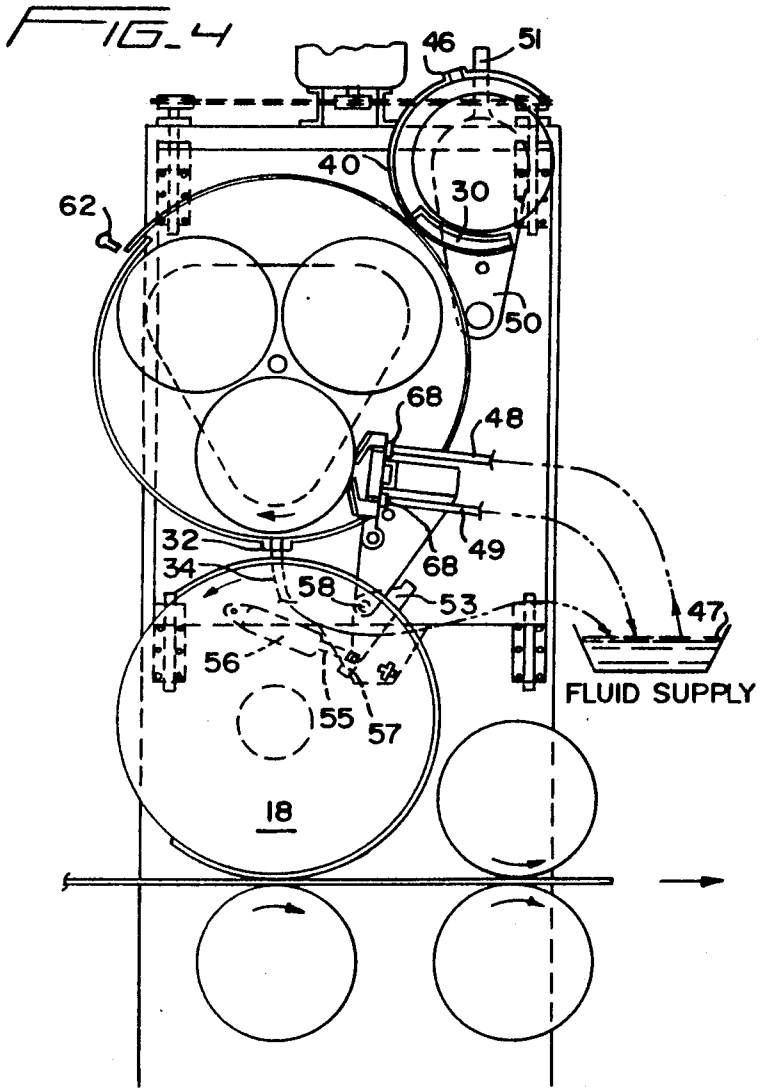
FIG. 4 is a partial schematic view in elevation in which a single printing station according to the invention is shown in the course of a cleaning operation using the doctor blade mode of operation.
Figure 3:
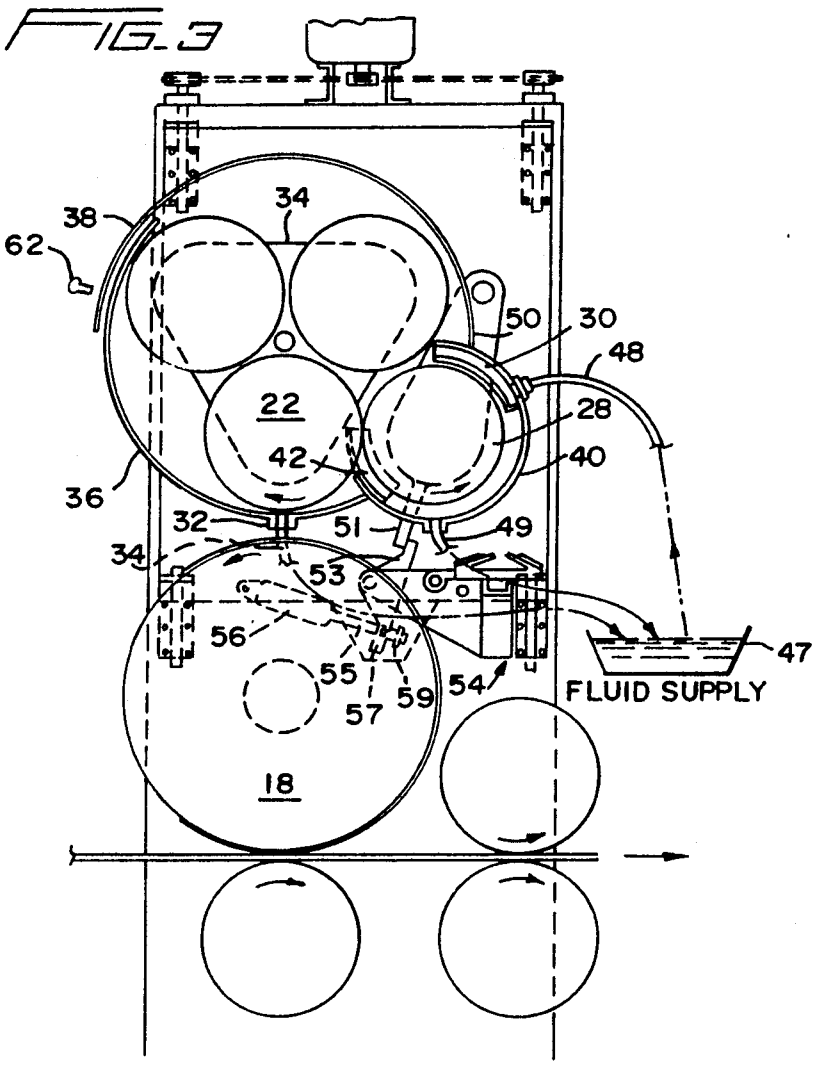
FIG. 3 is a partial schematic view in elevation in which a single printing station according to the invention is shown in the course of a cleaning operation using the wipe roll mode of operation.

In FIGS. 3 and 4, the inner frame 23 is shown moved to its upper position in which the selected anilox roll 22 is disengaged and spaced from the printing cylinder 18. In FIG. 3, the printing station is in the wipe roll mode of operation, and it will be seen that the arrangement of the anilox roll assembly 20 and the wipe roll assembly 28, 40 are the same as in FIG. 1, except that the lower cover member 36 associated with the anilox roll assembly 20 can now be moved to where its lower free end contacts the bottom surface of the fixed cover 40, by virtue of the bottom roll 22 of the anilox roll assembly being shifted upwardly away from the printing cylinder 18. In this position, it will be seen that the covers 36, 38 and 40 together form a sealed casing around the anilox roll assembly and the wipe roll, so that these units or assemblies can be cleaned by means of a suitable cleaning fluid introduced by a high pressure hose or the like, placed within the confines of the covers 36, 38, 40. Such a hose is shown as 48 in FIG. 3, and may be connected directly to the supply channel 30 and hence into the interior space defined by the covers (see also FIG. 5). Again, a manually operated pin 62 can be inserted into aligned slots or holes, provided for that purpose on the cover members, for locking in place the covers 36 and 38 to their selected positions for a cleaning operation.

Figure 9:
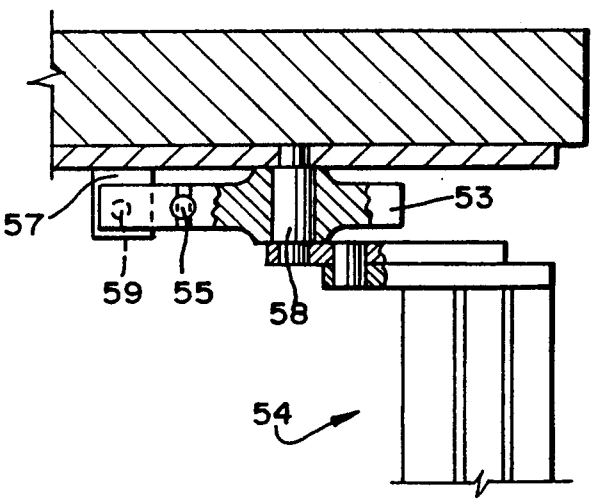
FIG. 9 is a side elevation view partly in section taken generally in the planes of the multi-angled line of 9—9 of FIG. 1.
Figure 8:
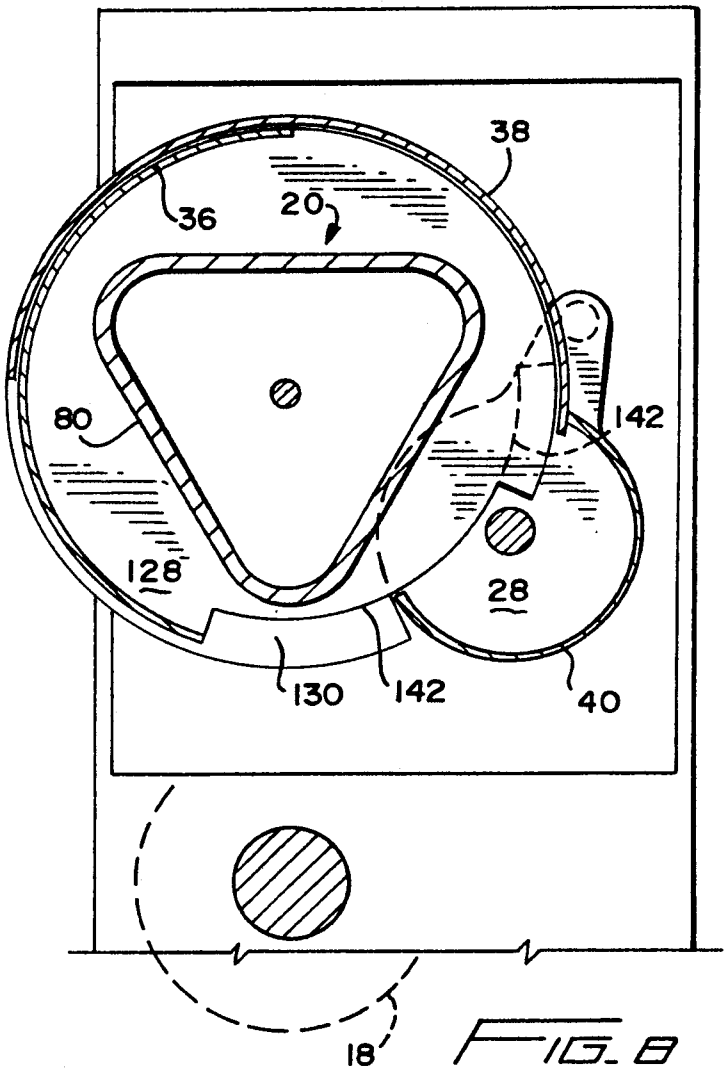

Also, the wipe roll support member 50 is seen to have an extension bar member 51 which is engaged by one end of a pivot lever 53 pivoted about the same axis as the doctor blade assembly 54 (see also FIG. 9). The pivot lever 53 is actuated by an air cylinder 56, an actuating rod 55 of which is pivotally secured by a suitable pin to the pivot lever 53. A suitably mounted adjustable set-screw 59 allows for the arcuate movement of the pivot lever 53 to be stopped at its lower end which functions as a stop block 57; the adjustable set-screw 59 thereby insures that a proper pressure is maintained between the wipe roll 28 and the anilox roll 30 when the pivot lever 53 engages the extension 51 of the wipe roll support.

In FIG. 4, the printing station is shown in the doctor blade mode of operation, but with the covers 36, 38 adjusted for a cleaning operation to be performed. In this case, the wipe roll 28 is maintained in its inoperative position and held there by the locking pin 53. The doctor blade assembly 54 is shown positioned into its operative position with respect to the selected anilox roll 22.

The movable covers 36, 38 are moved to their selected positions so that their respective free ends both engage the doctor blade assembly and define a sealed container therewith. To insure that the free ends of the covers 36, 38 sealingly engage the doctor blade assembly (or each other in the case of the wipe roll mode of operation), suitable felt or rubber squeegee-like gasket fins can be provided along their respective edges. A cleaning fluid is fed by suitable pumps, not shown, through the supply conduit 48 which is connected to connector 68 to feed the cleaning fluid into the interior of the doctor blade assembly 54. Because of seals (not shown) at both ends of the doctor blade assembly, the interior reservoir thereof is a closed cavity, and the cleaning fluid therein is withdrawn through the return flow conduit 49 back to the fluid supply 47. At the same time the anilox roll assembly 20 is rotated and is also cleaned, any excess cleaning fluid escaping through the outlet 32 and hose or conduit 34 back to the supply 47.

As mentioned above, the printing operations shown in FIGS. 1 and 2 require that the fluid supply 47 be ink for both the wipe roll mode of operation or the doctor blade mode of operation. In the case of the former, as shown in FIG. 1, ink is fed by a suitable pumping means, not shown, through conduit 48 and into ink supply channel 30 associated with the fixed cover member 40 (see also FIG. 5) which means ink is supplied through channel 30 in the direction of the arrow and into the upper nip cavity between anilox roll 22 and wipe roll 28. Excess ink spills out the ends of the nip, and is collected by means of the fixed cover 40 with the help of the right angled extension members 42, so that any excess ink can escape through outlet 46 and flexible conduit 49 back to the ink supply. The inking supply and return feed continues, of course, while the printing operation continues and printing cylinder 18 (continually inked by the anilox roll 22) prints the topside of the sheets 10 as they pass through the printing station. In FIG. 2, the same printing operation is performed on the sheets 10; however, the doctor blade assembly replaces the wipe roll assembly, as described above. In this case, ink is supplied by suitable pump means, not shown, through the flexible conduit or hose 48 and connector 68 into the doctor blade assembly, that is, into the reservoir cavity between the doctor blades and a portion of the surface of the anilox roll 22 between these blades. Excess ink returns through the ink return conduit 49 back to the ink supply.

For the cleaning or washing operations shown in FIGS. 3 and 4, the following sequence of operations takes place.

After a printing operation in the wipe roll mode of operation is completed, the fluid supply 47 is changed to a cleaning fluid which is fed through the system as described above. Thus, both the wipe roll assembly and the anilox roll assembly are cleaned simultaneously, as shown in FIG. 3.

In the doctor blade mode of printing, however, a different sequence of steps is employed. While the doctor blade is cleaned, as described above and as shown in FIG. 4, the dirty anilox roll is rotating as well and will be cleaned by virtue of the fluid intercourse between the anilox roll and the doctor blade assembly, that is, the surface of the anilox roll between the doctor blades as the anilox roll is rotated. As previously mentioned, any excess cleaning fluid escapes through the outlet 32 and flexible hose 34 back to the cleaning fluid supply 47. It will be seen from the above that this cleaning operation is confined between the selected anilox roll and the doctor blade assembly. The other anilox rolls remain clean from a previous cleaning operation.

Figure 5:
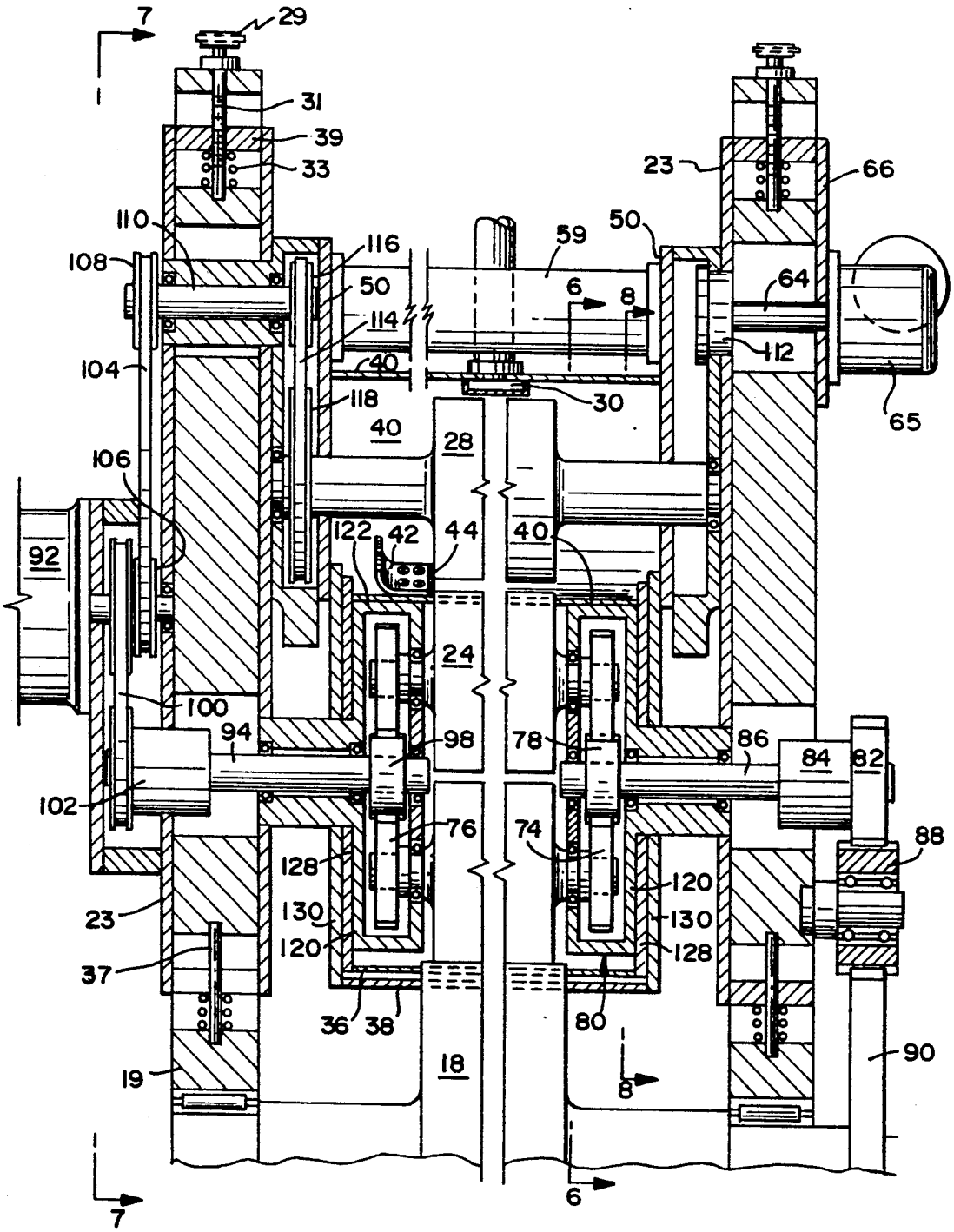
FIG. 5 is a side elevation view partly in section taken generally in the planes of the multi-angled line of 5—5 of FIG. 1.
Figure 7:
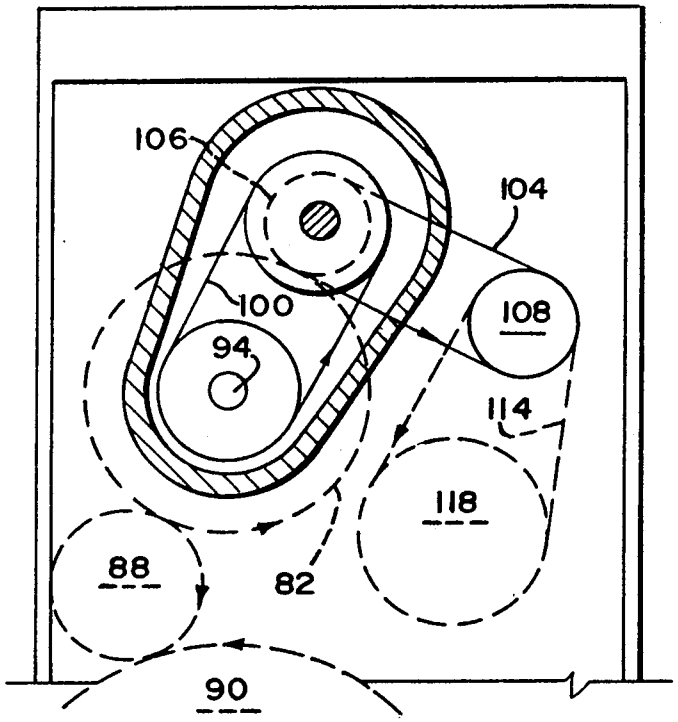
FIG. 7 is a side elevation view partly in section taken generally in the plane of the line 7—7 in FIG. 5.

Proceeding now to FIG. 5 and FIG. 7, the various drives and belts for the anilox roll assembly will be briefly described, it being understood that the belts, drives and clutches for the present invention are as essentially described in my aforementioned copending application. Both ends of each of the three anilox rolls 22, 24 and 26 include a spur gear, a gear 74 on the right end and gear 76 on the left end. The gears on the right ends mesh with a central drive gear 78 mounted centrally in a triangular gear case 80 (see also FIG. 6). This central drive gear 78 is driven by an anilox roll drive gear 82, located outside the main frame 19, through an electric clutch 84 on a main input drive shaft 86. The anilox roll drive gear 82 is driven through an idler gear 88 by a printing cylinder drive gear 90 which in turn is driven by a main machine drive motor via a machine gear train, not shown. The anilox rolls 22, 24, 26 are rotatably driven by the foregoing gears when the bottom anilox roll 22 is in the printing position, that is, in the position to apply ink to the printing die.

When the inner frame 23 is translated to bring the bottom anilox roll 22 out of engagement with the printing cylinder 18, this anilox roll is preferably still driven at low speed to keep the ink on it from drying. Also, when the inner frame is in its upper position, so that a cleaning operation can take place, the anilox roll drive gear 82 will necessarily lift out of mesh with the idler gear 88.

When the anilox roll assembly is moved away from the print cylinder (such as during print interruption), and when the doctor blade system is being used, the anilox side the left main frame in FIG. 5). An auxiliary input drive shaft 94 is connected to an auxiliary central drive gear 98 at the left in FIG. 5 and is coaxial with the right central drive gear 78. The auxiliary gear 98 is driven by the motor 92 through a timing belt 100 surrounding timing belt pulleys on the output shaft of the motor 92 and on an electric clutch 102 on the auxiliary input drive shaft 94. When the wipe roll 28 is being used, friction between the wipe roll and the engaged anilox roll turns the anilox roll, the wipe roll being driven by the wipe roll drive motor 92. In this situation the auxiliary electric clutch 102 is de-energized.

The wipe roll 28 is driven by a timing belt 104 surrounding a timing belt pulley 106 (see also FIG. 7) outside the left of the inner frame 23, on the output shaft of the wipe roll motor 92 and a timing belt pulley 108 on a spindle 110. This spindle 110 serves as a pivot, together with the coaxially aligned pivot member 112 disposed on the back of the inner frame 23, for the wipe roll support arm 50. Power is transmitted by the spindle 110 which is bearing mounted in the front of the inner frame 23. Another timing belt 114 surrounds a pulley 116 on the inner end of the spindle 110 and a pulley 118 on the left end of the wipe roll 28. Since the wipe roll, when used, always rotates at a constant speed regardless of machine speed, the wipe roll need not be driven on the right side (in FIG. 5) as are the three anilox rolls. It will be appreciated that during printing, the anilox rolls are driven by the print cylinder, regardless of whether the wipe roll or doctor roll system is used, so that the anilox roll does not wipe the surface of the printing die.

The triangular gear cases 80 for the three anilox rolls are made with removable bearing caps 120, 122, 124 (see also FIG. 6). As shown in FIG. 6, mounting bolts 126 can be removed to free the bearing caps at each end and then the selected anilox roll can be lifted out of the gear cases, the end gears 74, 76 disengaging and merely coming out of mesh.

The wipe roll 28 may be removed by first pivoting the support arms 50 to the position shown in FIG. 2. The belt 114 on the inside of the drive spindle 110 is pulled off the flangeless pulley 116. The larger pulley 118 on the end of the wipe roll 28 includes flanges for guiding the belt 114. Once the bolts, shown in dotted lines in FIG. 6, are removed, the bearing cap (also shown in dotted lines) can be removed and thus the wipe roll can be lifted out of its bearing sockets in the support arms 50.

In order to pivot the wipe roll 28 into and out of its printing positions, as shown in FIGS. 1 and 2, the support arms 50 are shown to be connected by a cross shaft 59 about which the support arms for the wipe roll can pivot. The rotary or pivotal motion is imparted to the cross shaft 59 by means of a connecting shaft 64 connected to pivot member 112 which in turn is connected to the cross shaft 59. The shaft 64 is connected to a bi-directional gear motor 65 mounted on a side plate 66 similar to side plate 23 on the opposite side of the main frame 19.

Figure 8:
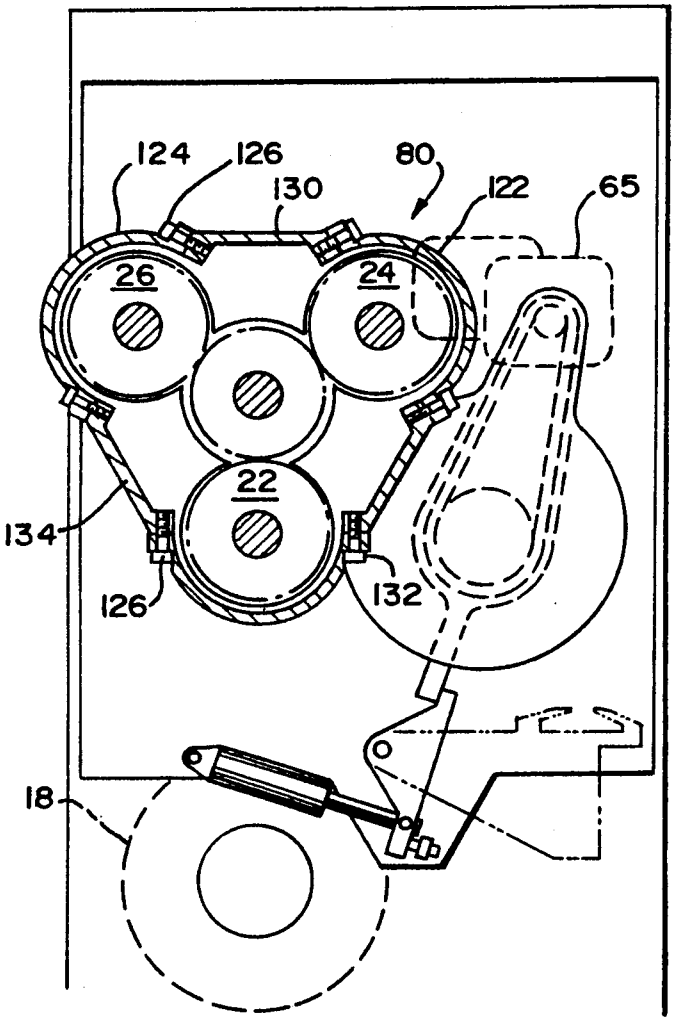
FIG. 8 is a side elevation view partly in section taken generally in the plane of the line 8—8 in FIG. 5.

Also shown in FIG. 5 are end plates 128, 130 associated with the respective cover members 36 and 38 (see also FIG. 8). These end plates 128, 130 slide one past the other when the cover members are moved to their selected positions, as explained above. Also shown, is the right angled extension member 42 secured near the end of the cover member 40 for the wipe roll 28. The felt or rubber seal 44 is shown adjacent the end of the wipe roll 28.

In FIG. 8, the end plates 128, 130 of the respective cover members 36, 38 are shown to have arcuate notches 142 which will allow the cover members 36, 38 to be coaxially rotated without the perimeters of the end plates interfering with the shaft of the wipe roll 28. The anilox roll assembly 20 is shown in a simplified form, and below that a portion of the printing cylinder 18 is shown in phantom.

To change the selection of the anilox roll, the subframe 23 is translated vertically to its upper position, as in FIGS. 3 and 4, and both the wipe roll 28 and the doctor blade head assembly 54 are swung into their inoperative positions. Then, the anilox roll assembly 20 can be partially rotated about its rotational axis 21 till the next anilox roll 24 or 26 to be selected is in the lower position (occupied by roll 22 in FIGS. 3 and 4). Releasable latch arrangements lock the triangular end gear cases 80 in their selected rotational positions to lock the selected anilox roll in position. Due to the vertical translatory movement of the inner subframe 23, and the anilox roll assembly 20 together with the wipe roll assembly 28, it can be made feasible to perform this changing of the selection of the anilox roll without detaching and spacing this printing section from the adjoining section or sections, whether they are being used for printing or otherwise. In the arrangement in FIGS. 1 to 4, it would be necessary to ensure that the geometry and extent of movement, and the various dimensions, are such that the wipe roll assembly 28, 40, 50 would clear the upper elements of the next downstream section when the movable subframe 23 is in a raised position. This is particularly advantageous in a flexographic container blank processing machine having two, three, or more printing sections.

The above described embodiments, of course, are not to be construed as limiting the breadth of the present invention. Modifications, and other alternative constructions, will be apparent which are within the spirit and scope of the invention as defined in the appended claims.

For example, while it is preferred that the cover members for confining fluid to the anilox roll and the wipe roll assemblies be rotated manually about their axis, it is within the scope of the invention that a power-assist system may be employed, such as suitable air cylinders, much in the manner that the previously described air cylinder is employed for swinging the pivot lever for holding the wipe roll against the anilox roll.

Also, the locking means for holding the covers in their selected rotary positions may be transferred from the position described above and re-located at the juncture between the free ends of the covers and the parts of the system with which they engage; that is, a locking means could be provided where the covers for the anilox roll assembly meet the cover for the wipe roll assembly, and, similarly, a locking means could be provided between the covers for the anilox roll assembly and where these covers meet the doctor blade assembly.

Further, instead of having a fluid supply conduit used in common for both ink and washing fluid, separate fluid supply conduits may be provided for the ink and the washing fluid; thus, there may be a plurality of fluid supply conduits. Similarly, separate fluid return conduits may be provided for ink and washing fluid; thus there may be one, two, or more fluid return conduits.

What is claimed is:

1. A printing apparatus, comprising:

a main frame;

a printing cylinder rotatably supported by said main frame;

a subframe movably mounted relative to said main frame and supporting an anilox roll assembly;

means for moving said subframe with respect to said main frame for moving said anilox roll assembly into and out of engagement with said printing cylinder;

means for supplying fluid to said anilox roll assembly for supplying ink for a printing operation and for supplying a cleaning fluid for a washing operation of at least said anilox roll assembly;

movable cover means at least partially surrounding said anilox roll assembly and being movable into selected positions, for allowing said anilox roll assembly to cooperate with said printing cylinder when said anilox roll assembly is in engagement with said printing cylinder for said printing operation and for effectively encircling said anilox roll assembly when said anilox roll assembly is out of engagement with said printing cylinder for said washing operation;

a wipe roll cooperative with said anilox roll assembly and a doctor blade assembly cooperative with said anilox roll assembly; and a separate cover partially surrounding said wipe roll and engaging said movable cover means to surround said anilox roll assembly and said wipe roll when said wipe roll is cooperative with said anilox roll assembly with said anilox roll assembly out of engagement with said printing cylinder.

2. The printing apparatus of claim 1, wherein said anilox roll assembly and said fluid supplying means are disposed generally above said printing cylinder.

3. The printing apparatus of claim 1, wherein said movable cover means comprises a plurality of concentric cylindrical covers, one of said cylindrical covers being movable with respect to another of said cylindrical covers to thereby effect said selected positions.

4. The printing apparatus of claim 3, wherein said cylindrical covers include end plates juxtaposed and movable, one with respect to another, to thereby effect seals at opposite ends of said anilox roll assembly.

5. The printing apparatus of claim 1, wherein said anilox roll assembly comprises a plurality of anilox rolls rotatable about parallel spaced apart axes, said assembly being rotatable with respect to said subframe about a central axis parallel to and between said spaced-apart axes.

6. The printing apparatus of claim 5, wherein said fluid supplying means includes at least one fluid supply line and at least one fluid return line.

7. The printing apparatus of claim 6, wherein said supply line leads from a fluid supply, and said supply line serves as a conduit for both said ink and said cleaning fluid.

8. The printing apparatus of claim 6, wherein said wipe roll and said doctor blade assembly are pivotal in opposite directions about axes parallel to said central axis to inoperative positions providing sufficient clearance for rotation of said anilox roll assembly.

9. The printing apparatus of claim 8, wherein said wipe roll and said doctor blade assembly alternately cooperate with a selected anilox roll of said anilox roll assembly at approximately the same peripheral location of said selected anilox roll.

10. The printing apparatus of claim 8, wherein said doctor blade assembly comprises a connecting means for said fluid supply line and said fluid return line, said supply line and said return line serving as conduits for both ink and said cleaning fluid.

11. The printing apparatus according to claim 10, wherein said fluid supply line and said fluid return line respectively lead to a fluid supply.

12. A printing apparatus, comprising:

a main frame;

a printing cylinder rotatably supported by said main frame;

a subframe movably mounted relative to said main frame and supporting an anilox roll assembly;

means for moving said subframe with respect to said main frame for moving said anilox roll assembly into and out of engagement with said printing cylinder;

means for supplying fluid to said anilox roll assembly for supplying ink for a printing operation and for supplying a cleaning fluid for a washing operation of at least said anilox roll assembly;

movable cover means, at least partially surrounding said anilox roll assembly and being movable into selected positions, for allowing said anilox roll assembly to cooperate with said printing cylinder when said anilox roll assembly is in engagement with said printing cylinder for said printing operation and for effectively encircling said anilox roll assembly when said anilox roll assembly is out of engagement with said printing cylinder for said washing operation;

said anilox roll assembly comprising a plurality of anilox rolls rotatable about parallel spaced apart axes, said assembly being rotatable with respect to said subframe about a central axis parallel to and between said spaced-apart axes;

said fluid supplying means including at least one fluid supply line and at least one fluid return line;

a wipe roll assembly cooperative with said anilox roll assembly, and a doctor blade assembly cooperable with said anilox roll assembly;

said wipe roll assembly and said doctor blade assembly being pivotally mounted on said subframe and being pivotal in opposite directions about axes parallel to said central axis to inoperative positions providing sufficient clearance for rotation of said anilox roll assembly; and said wipe roll assembly further comprising:

a wipe roll;

a fixed cover partially surrounding said wipe roll assembly, said fixed cover being movable with said wipe roll assembly and engaging with said movable cover means to surround said anilox roll assembly and said wipe roll when said wipe roll assembly is pivoted into engagement with said anilox roll assembly when said anilox roll assembly is out of engagement with said printing cylinder;

means for connecting said supply line and said return line to said fixed cover, said supply line and said return line serving as conduits for both said ink and said cleaning fluid; and an outlet means in said movable cover means connected to a further fluid return line for drainage of any excess fluid collected in said movable cover means during said washing operation.

13. An apparatus having a series of printing stations arranged one adjacent another, each of said stations comprising:

a main frame;

a printing cylinder rotatably supported by said main frame;

a subframe having supported thereon an anilox roll assembly, and a fluid supplying assembly cooperating with said anilox roll assembly;

said anilox roll assembly comprising a plurality of spaced apart anilox rolls;

an extendible and contractible main cover at least partially surrounding said anilox roll assembly, and a separate cover partially surrounding at least part of said fluid supplying assembly;

said separate cover being movable between operative and inoperative positions, said separate cover contacting and forming a continuation of said main cover in the operative position but not forming a continuation of said main cover in the inoperative position;

means for moving said subframe with respect to said main frame to thereby move said anilox roll assembly into and out of engagement with said printing cylinder for selecting and performing, respectively, a printing operation and a washing operation; and means for interrelating said main cover, said separate cover, and said moving means for enabling either of said operations to be selected and performed while either the same or a different one of such operations is performed at an adjacent one of said stations.

14. The apparatus of claim 13, wherein said means for moving said subframe moves said subframe in a translatory and essentially vertical direction.

15. The apparatus of claim 13, wherein said subframe is disposed above said printing cylinder.

16. The apparatus of claim 13, wherein said cover is movable into a first extended position for allowing said anilox roll assembly to cooperate with said printing cylinder during said printing operation and into a second differently extended position for said washing operation.

17. The apparatus of claim 13, wherein said fluid supplying assembly in said each station comprises a wipe roll assembly and a doctor blade assembly.

18. The apparatus of claim 17, wherein said wipe roll assembly and said doctor blade assembly in said each station alternately cooperate with any selected anilox roll of said anilox roll assembly at approximately the same peripheral location of said selected anilox roll.

19. A printing apparatus, comprising:

a main frame;

a printing cylinder rotatably supported in said main frame;

a subframe having supported thereon an anilox roll assembly and a fluid supplying mechanism for cooperating with said anilox roll assembly and supplying fluid thereto;

said anilox roll assembly comprising a plurality of anilox rolls rotatable about parallel spaced apart axes, said anilox roll assembly being rotatable with respect to said subframe about an assembly axis parallel to and between said spaced-apart axes;

means for moving said subframe with respect to said main frame for moving said anilox roll assembly into and out of engagement with said printing cylinder; and said assembly axis being movable towards and away from said printing cylinder by said moving means when moving said subframe, said anilox roll assembly being rotatable about said assembly axis when said moving means moves said assembly axis away from said printing cylinder to place said anilox roll assembly out of engagement with said printing cylinder.

20. The printing apparatus of claim 19, wherein said anilox roll assembly and said fluid supplying mechanism are disposed generally above said printing cylinder.

21. The printing apparatus according to claim 19, wherein said fluid supplying mechanism includes a fluid supply line and a fluid return line, said supply line and said return line leading to a fluid supply.

22. The printing apparatus of claim 21, further comprising a movable cover means partially surrounding said anilox roll assembly and being movable into selected positions for allowing said anilox roll assembly to cooperate with said printing cylinder during said printing operation and for allowing said movable cover means to cooperate with said fluid supplying mechanism during said printing operation and said washing operation.

23. The printing apparatus of claim 19, wherein said fluid supplying mechanism includes a wipe roll assembly disposed to the one side of said anilox roll assembly and a doctor blade assembly disposed tot he same side of said anilox roll assembly.

24. The printing apparatus of claim 23, wherein said wipe roll assembly and said doctor blade assembly are pivotally mounted on said subframe, said wipe roll assembly and said doctor blade assembly being pivotal in opposite directions about axes parallel to said assembly axis to wholly inoperative positions to thereby provide sufficient clearance for rotation of said anilox roll assembly.

25. The printing apparatus of claim 23, comprising means for pivoting said wipe roll assembly and said doctor blade assembly about axes parallel to said assembly axis for alternately effecting cooperation with a selected anilox roll of said anilox roll assembly at approximately the same peripheral location of said selected anilox roll.

26. The printing apparatus of claim 23, wherein said doctor blade assembly comprises means for connecting said doctor blade assembly to said fluid supply line and to said fluid return line, said supply line and said return line serving as conduits for both ink and a cleaning fluid.

27. A printing apparatus, comprising:

a main frame;

a printing cylinder rotatably supported in said main frame;

a subframe having supported thereon an anilox roll assembly and a fluid supplying means for cooperating with said anilox roll assembly and supplying fluid thereto;

said anilox roll assembly comprising a plurality of anilox rolls rotatable about parallel spaced apart axes, said assembly being rotatable with respect to said subframe about an axis parallel to and between said spaced-apart axes;

means for moving said subframe with respect to said main frame for moving said anilox roll assembly thereon into and out of engagement with said printing cylinder for effecting, respectively, a printing operation and a washing operation;

said fluid supplying means including a fluid supply line and a fluid return line, said supply line and said return line leading to a fluid supply;

a movable cover means partially surrounding said anilox roll assembly and being movable into selected positions for allowing said anilox roll assembly to cooperate with said printing cylinder during said printing operation and for allowing said movable cover means to cooperate with said fluid supplying means during said printing operation and said washing operation;

said fluid supplying means including a wipe roll assembly disposed to one side of said anilox roll assembly and a doctor blade assembly disposed to the same side of said anilox roll assembly;

said wipe roll assembly and said doctor blade assembly being pivotally mounted on said subframe, said wipe roll assembly and said doctor blade assembly being pivotal in opposite directions about axes parallel to said anilox roll assembly axis to wholly inoperative positions to thereby provide sufficient clearance for rotation of said anilox roll assembly; and said wipe roll assembly further comprising:

a fixed cover partially surrounding and fixed relative to said wipe roll assembly, said fixed cover being movable with said wipe roll assembly and cooperating with said movable cover means to more fully surround said anilox roll assembly when said wipe roll assembly is pivoted into engagement with said anilox roll assembly; and means for connecting said wipe roll assembly to said fluid supply line and to said fluid return line, and said supply line and said return line serving as conduits for both ink and a cleaning fluid.

28. A printing apparatus, comprising:

a main frame;

a printing cylinder rotatably supported by said main frame;

a subframe movably mounted relative to said main frame;

an anilox roll assembly rotatably supported in said subframe, said anilox roll assembly comprising at least two anilox rolls;

said anilox roll assembly being located above said printing cylinder;

a wipe roll assembly mounted on said subframe;

said wipe roll assembly comprising a wipe roll and a cover around said wipe roll;

a doctor blade assembly mounted on said subframe;

an adjustable cover around said anilox roll assembly, said adjustable cover having an adjustable peripheral opening for penetration, respectively, by said wipe roll assembly and said doctor blade assembly;

means for moving said subframe to bring said anilox roll assembly into and out of engagement with said printing roll to establish, respectively, an operative position for printing and an inoperative position for washing;

means for moving said wipe roll into and out of contact with said anilox roll assembly;

means for moving said doctor blade assembly into and out of contact with said anilox roll assembly; and said adjustable peripheral opening being penetrated by either said wipe roll assembly or said doctor blade assembly in both said operative position for printing and said inoperative position for washing.

29. The printing apparatus of claim 28, wherein the wipe roll cover is fixed relative to said wipe roll assembly and has an opening through which a portion of said wipe roll protrudes.

* * * * *